US006044852A

United States Patent [19]

Epperson, Jr. et al.

[11] Patent Number: 6,044,852

[45] Date of Patent: Apr. 4, 2000

[54] PARTS WASHER

[75] Inventors: Bill George Epperson, Jr., Beaverton, Oreg.; Paul W. Linton, Vancouver, Wash.; Hal W. Hardinge, Lake Oswego, Oreg.; David Allan Bergerud, Vancouver, Wash.

[73] Assignee: Landa, Inc., Portland, Oreg.

[21] Appl. No.: 08/888,763

[22] Filed: Jul. 7, 1997

Related U.S. Application Data

[63] Continuation-in-part of application No. 08/707,943, Sep. 10, 1996.

[51] Int. Cl.[7] ..... B08B 3/02

[52] U.S. Cl. ..... 134/56 R; 134/58 R; 134/108; 134/174; 134/176; 239/247

[58] Field of Search ..... 134/56 R, 57 R, 134/58 R, 105, 108, 113, 179, 176, 200; 239/243, 247, 253

[56] References Cited

U.S. PATENT DOCUMENTS

| | | | |
|---|---|---|---|
| 1,204,806 | 11/1916 | Maclean | 134/179 |
| 1,417,162 | 5/1922 | Gagen | 134/179 |
| 1,475,489 | 11/1923 | Hicks | 134/179 |

(List continued on next page.)

FOREIGN PATENT DOCUMENTS

| | | | |
|---|---|---|---|
| 1 293 424 | 4/1969 | Germany . | |
| 6-38917 | 2/1994 | Japan | 134/199 |
| 239513 | 3/1969 | Russian Federation | 134/176 |

OTHER PUBLICATIONS

Cuda Corporation, Automatic Parts Washer brochure, 1994.
Citation Industries Heavy Duty Jet Washer brochure.
JBI Industries Spray Jet Parts Washers brochure.
The Hotsy Corpo., Hotsy Tubs brochure, 1990.
U.S. Application No., 29/055,839, Linton et al., filed Jun. 13, 1996.
Hydro–Blast Inc., Automatic Cabinet Parts Washer brochure.
Better Engineering, Mfg., Inc., The Purifiers Jet Washers brochure, 1992.
Landa Spin Jet Automatic Parts Washer brochure, 1996.
*Precision Cleaning*, vol. III, No. 8, Sep. 1995.
Landa Spray Jet Parts Washer brochure, Jan. 1995.
Landa, Spray Jet Parts Washer Operator's Manual.
Midco International Inc., Economite Power Gas Conversion Burners Installation and Service Instructions.
Grainger Industrial and Commercial Equipment and Supplies 1995 General Catalog No. 386, pp. 1554–1556, 1995.

*Primary Examiner*—Frankie L. Stinson
*Attorney, Agent, or Firm*—Kolisch, Hartwell, Dickinson, McCormack & Heuser

[57] ABSTRACT

A parts washer is disclosed. The parts washer includes a housing that has a washbasin or wash chamber defining an inner cavity and chargeable with a volume of fluid. A spray tube is rotatably positioned within the housing and has an axis of rotation. The spray tube is configured to define a volume of rotation as it rotates about its axis of rotation. A support structure configured to support parts to be washed is positioned within the housing and is substantially within the volume of rotation of the spray tube. The parts washer further includes a pump connected to the spray tube. The pump delivers fluid under pressure to the spray tube. The spray tube includes a plurality of outlets configured to direct fluid toward parts to be washed on the support structure and at least one outlet configured to direct fluid in a direction to cause fluid-propelled rotation of the spray tube about its axis of rotation. The parts washer may further include a heater, a first thermostat for measuring the temperature of fluid in the parts washer and automatically disengaging the heater if the temperature of the fluid exceeds a defined maximum temperature, and a second thermostat for controlling the heater to maintain the temperature of fluid in the parts washer between defined upper and lower temperatures. Furthermore, the parts washer may include a pressure switch for disengaging the pump and/or the heater if pressure from fluid in the parts washer is less than a defined minimum pressure, and an auxiliary spray tube that is adjustably mounted on the spray tube and includes a second plurality of outlets. A method for using the parts washer is also disclosed.

26 Claims, 12 Drawing Sheets

U.S. PATENT DOCUMENTS

| | | | |
|---|---|---|---|
| 1,502,863 | 7/1924 | Merseles . | |
| 1,638,549 | 8/1927 | Ohmart . | |
| 1,668,923 | 5/1928 | Rymann . | |
| 1,690,974 | 11/1928 | Hazard et al. | 134/176 |
| 1,833,374 | 11/1931 | Renshaw . | |
| 1,897,821 | 2/1933 | Poli | 134/179 |
| 1,927,665 | 9/1933 | Kirby . | |
| 2,078,670 | 4/1937 | Kirby . | |
| 2,177,219 | 10/1939 | Lewis . | |
| 2,320,133 | 5/1943 | Horwitz | 134/179 |
| 2,588,856 | 3/1952 | La Raus . | |
| 2,621,666 | 12/1952 | Ornas | 134/108 |
| 2,666,439 | 1/1954 | Bechtol | 134/108 |
| 2,704,082 | 3/1955 | Jackson . | |
| 2,764,171 | 9/1956 | Nolte . | |
| 2,905,393 | 9/1959 | Federighi et al. . | |
| 3,020,918 | 2/1962 | Albertson et al. . | |
| 3,162,205 | 12/1964 | Bolkow | 134/180 |
| 3,324,867 | 6/1967 | Freese . | |
| 3,598,130 | 8/1971 | Nolte et al. . | |
| 3,774,261 | 11/1973 | Colt . | |
| 3,844,299 | 10/1974 | Athey et al. | 134/113 |
| 3,971,394 | 7/1976 | Osborne . | |
| 4,134,414 | 1/1979 | Jarvis et al. . | |
| 4,157,096 | 6/1979 | Miller, Jr. | 134/179 |
| 4,255,079 | 3/1981 | Piegza . | |
| 4,279,384 | 7/1981 | Yamamoto | 134/108 |
| 4,641,671 | 2/1987 | Nogi et al. | 134/113 |
| 4,752,289 | 6/1988 | Balding et al. . | |
| 4,834,836 | 5/1989 | Wemhoff . | |
| 4,995,409 | 2/1991 | Watts . | |
| 5,107,876 | 4/1992 | Ozyjiwsky . | |
| 5,549,128 | 8/1996 | Mansur | 134/108 |
| 5,653,247 | 8/1997 | Murakami . | |

Fig. 9
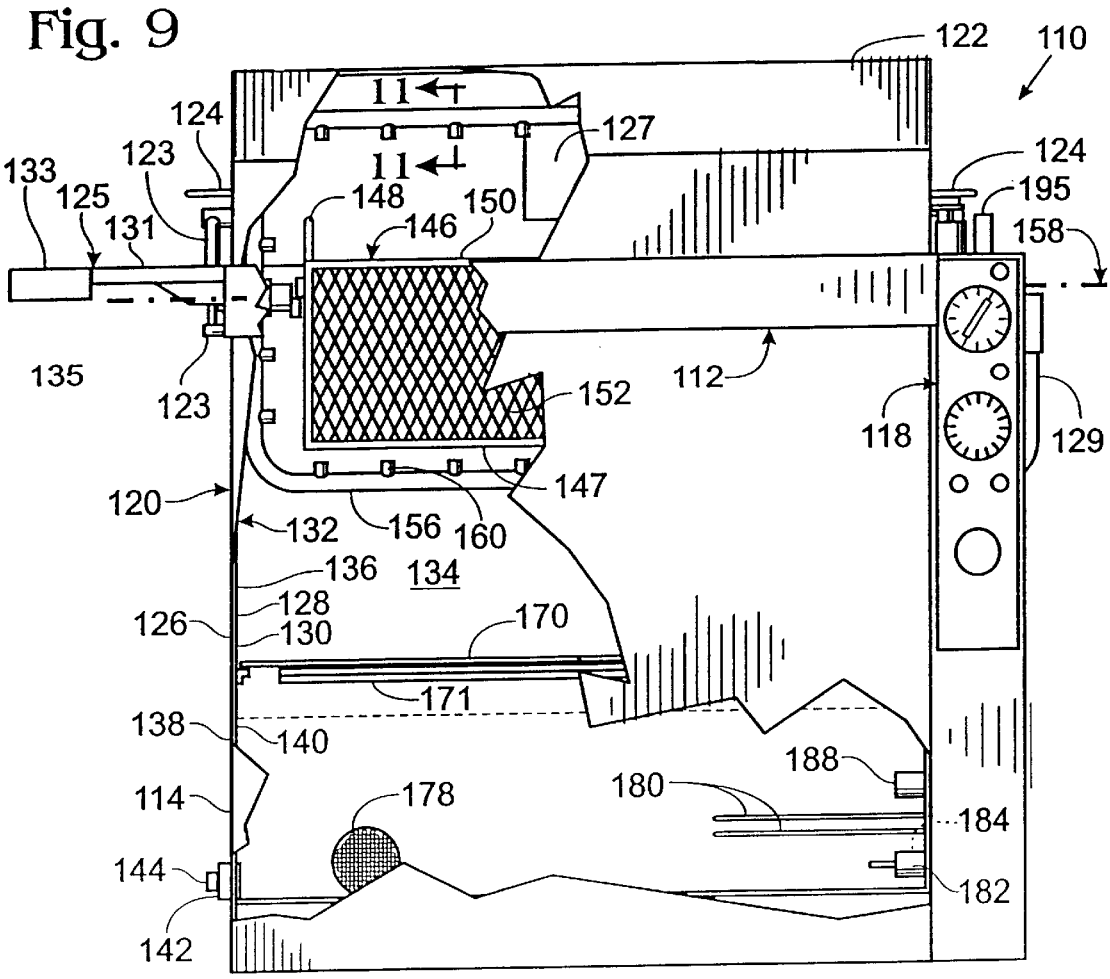
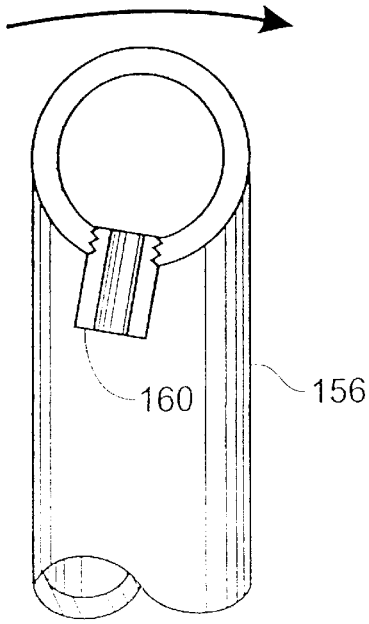
Fig. 11

PARTS WASHER

RELATED APPLICATION

This is a continuation-in-part application of co-pending application, Ser. No. 08/707,943, which was filed on Sep. 10, 1996, is entitled "Parts Washer," still pending and the disclosure of which is hereby incorporated by reference.

FIELD OF THE INVENTION

This invention relates generally to parts washers. More particularly, the invention relates to a parts washer with a fluid-propelled spray tube.

BACKGROUND

A parts washer is an apparatus that cleans machinery parts. Parts washers generally use an aqueous cleaning solution to remove such things as grease, carbon, resins, tar, inks, and other grime from dirty parts like engine parts, tools, etc.

A conventional parts washer includes a rotating tray for supporting parts to be washed and a series of nozzles for directing the cleaning solution toward the parts on the tray. A pump delivers cleaning solution under pressure to the nozzles, which are fixedly mounted within the parts washer to direct cleaning solution at a particular region of the tray. A motor and a drive assembly are used to rotate the tray about a central axis. Because of the considerable weight of the tray and the parts to be washed, the motor and drive assembly must be of sufficient power and strength to cause the tray to rotate, even when loaded with parts to be washed. The motor and drive assembly are expensive and utilize numerous parts that are subject to failure and that require frequent maintenance.

It is an object of the invention described in this document to address this problem by providing a support structure for supporting parts to be washed and a fluid-propelled spray tube that rotates about the support structure and sprays cleaning fluid on the support structure and parts to be washed that are on the support structure.

A conventional parts washer often further includes a heater for increasing the temperature of the cleaning fluid. The temperature and level of the fluid within the parts washer must be carefully controlled to prevent damage to the pump and other equipment. Conventional controls are subject to fouling and damage while the parts washer is in use.

It is a further object of the invention described in this document to provide more reliable and effective temperature and level control for a parts washer by using a series of thermostats and pressure switches as controllers and as automatic safety shut-offs.

SUMMARY OF THE INVENTION

The invented parts washer includes a housing that has a washbasin or wash chamber. The washbasin or wash chamber defines an inner cavity and is chargeable with a volume of fluid. A spray tube is rotatably coupled to the housing and has an axis of rotation. The spray tube is configured to define a volume of rotation as it rotates about its axis of rotation. A support structure for supporting parts to be washed is positioned within the housing and is substantially within the volume of rotation of the spray tube. The parts washer further includes a pump for delivering fluid under pressure to the spray tube. The spray tube further includes a plurality of outlets configured to direct fluid substantially toward parts to be washed on the support structure and at least one outlet on the spray tube configured to direct fluid in a direction to cause fluid-propelled rotation of the spray tube about its axis of rotation.

In one embodiment of the invention, the support structure for supporting parts to be washed is completely within the volume of rotation of the spray tube. In a variation of the invention, the spray tube substantially encircles the support structure. In a further variation of the invention, the plurality of outlets are spaced along the spray tube to direct fluid at parts to be washed from substantially all directions as the spray tube rotates about its axis of rotation. In another variation of the invention, the parts washer includes at least two outlets on the spray tube configured to direct fluid in a direction to cause fluid-propelled rotation of the spray tube about its axis of rotation. In another variation of the invention, the parts washer includes at least two outlets on the spray tube configured to direct fluid in a direction to cause fluid-propelled rotation of the spray tube about its axis of rotation. In a further embodiment of the invention, all of the outlets on the spray tube are configured to direct fluid substantially toward parts to be washed on the support structure and to cause fluid-propelled rotation of the spray tube about its axis of rotation.

A further embodiment of the invention includes one of the previously described parts washers, only further including a strainer below the volume of rotation of the spray tube. The strainer catches larger pieces that fall off the support structure, or that are removed from parts as they are washed, and retains these pieces so they do not damage the pump or other elements of the parts washer. The strainer also facilitates the later visual inspection of these pieces. In a variation of this embodiment, the strainer is substantially coextensive with the support structure.

In another embodiment of the invention, the support structure of one of the previously described parts washers has a perforated base. The base allows fluid and debris to pass through the support structure. In another variation, the support structure is removably positioned within the housing. This facilitates the support structure being removed from the parts washer in order to load parts to be washed onto the support structure, and then replaced in the parts washer once parts to be washed are loaded. In a further variation of the invention, the washbasin includes a bottom portion, and the parts washer further includes a sump that is connected to the bottom portion of the washbasin. In this variation, the inlet port of the pump is connected to the sump.

Another embodiment of the invention involves one of the previously described parts washers, only further including a heater for heating fluid within the sump. In variations of the invention, the heater is at least partially within the sump. In other variations, the parts washer further includes a first thermostat for measuring the temperature of fluid within the parts washer and automatically disengaging the heater if the temperature of the fluid exceeds a defined maximum temperature and a second thermostat for controlling the heater to maintain the temperature of fluid within the parts washer between defined upper and lower temperatures.

A further embodiment of the invention involves one of the previously described parts washers, only further including a pressure switch within the sump for disengaging the pump and the heater if pressure from fluid in the parts washer is less than a defined minimum pressure.

Yet another embodiment of the invention includes one of the previously described parts washers, in which the spray tube further includes an auxiliary spray tube adjustably and removably mounted on the spray tube and having a second plurality of outlets configured to direct fluid substantially towards parts to be washed on the support structure. In a variation of this embodiment, the second plurality of outlets are further configured to direct fluid in a direction to cause fluid-propelled rotation of the spray tube about its axis of rotation.

Various other features, objects and advantages of the present invention will become fully apparent as this description continues.

BRIEF DESCRIPTION OF THE DRAWINGS

FIG. 9 is a front view of the parts washer shown in FIG. 8 with the cover closed and a portion of the housing and the cover broken away.

FIG. 11 is a cross-section view of the spray tube taken along 11—11 in FIG. 9.

DETAILED DESCRIPTION OF THE PREFERRED EMBODIMENTS

Figure 1:
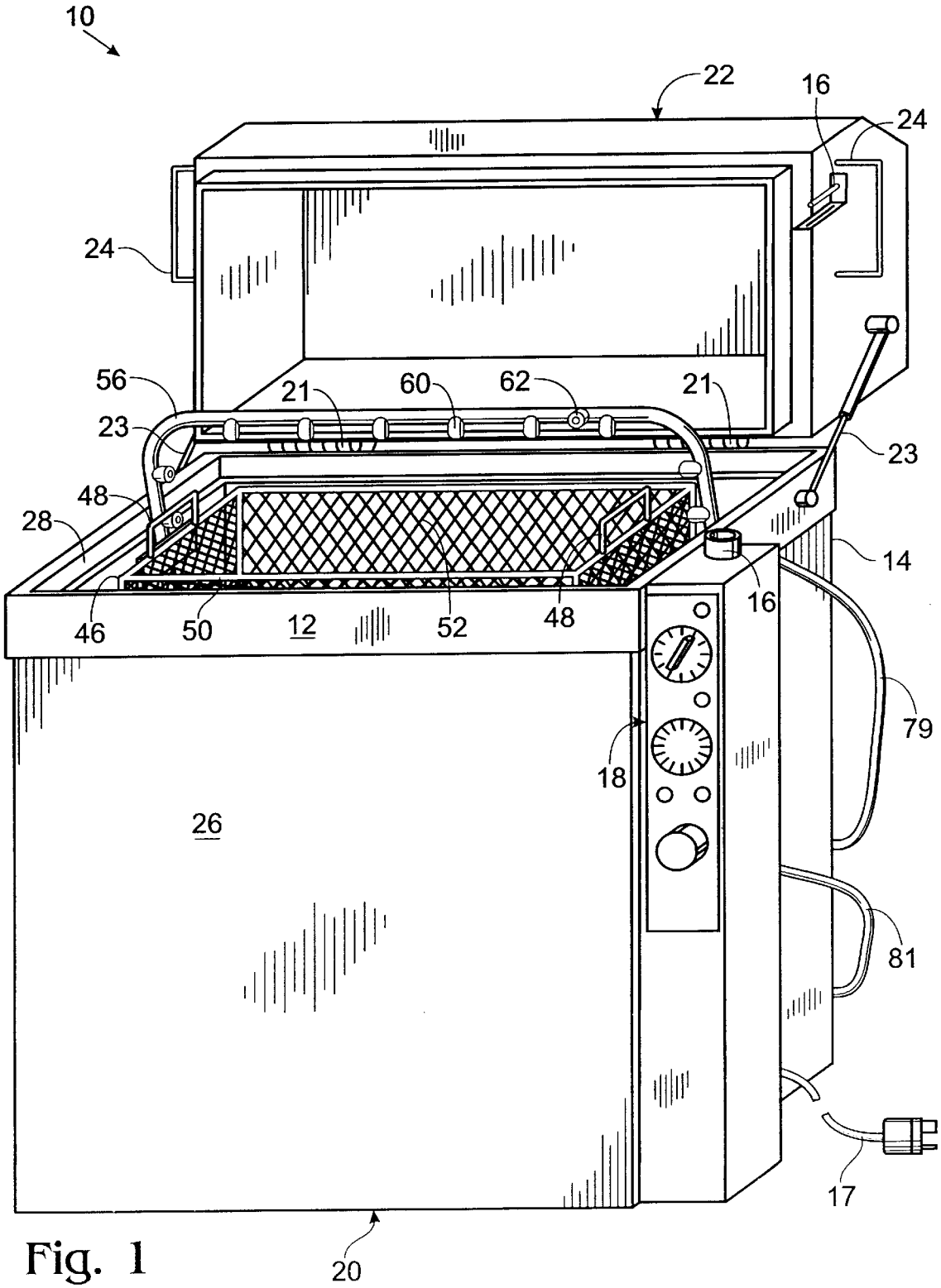
FIG. 1 is an isometric view of the invented parts washer with the cover open and the spray tube rotated to an upright position.

Referring now to the drawings, FIG. 1 depicts the parts washer of the invention, indicated generally at 10. The parts washer 10 has top and side regions, 12 and 14 respectively, and includes a housing 20. As shown in FIG. 1, the housing 20 has a cover 22, which is connected to the housing 20 by a pair of hinges 21. The cover may be opened and shut using handle portions 24 to provide and restrict access to the interior of the parts washer 10. A pair of hydraulic struts 23 are connected to the top region 12 of the housing 20 and the cover 22 and stabilize and support the cover 22 when it is raised to an open position.

The housing 20 further includes a solenoid safety latch 16, a control panel 18 and plural cover supports 25 (shown in FIGS. 3–6). The solenoid safety latch 16 is connected to the housing 20 and the cover 22 and prevents the cover 22 from being opened while the parts washer 10 is in use, as well as for a determined time period thereafter. The control panel 18 contains controls and indicators, including, but not limited to, status indicators, timers, temperature and wash cycle controls low fluid indicators and power switches. The control panel 18 is connected to a power supply (not shown) by a power cord 17. The pair of cover supports 25 further stabilize and support the cover 22 when it is raised to an open position. As shown in FIGS. 3–6, the cover supports 25 extend outwardly from the top region 12 of the housing 20 to provide a surface upon which the cover 22 may be supported.

The parts washer 10 shown in FIGS. 1–6 is a "top load" parts washer, with the cover 22 connected to the rest of the housing 20 to facilitate loading and unloading from the top region 12 of the parts washer 10. It should be understood that the present invention may be practiced using other configurations, such as a "side load" parts washer, where the cover is positioned to facilitate loading and unloading from one of the parts washer's side regions.

Figure 2:
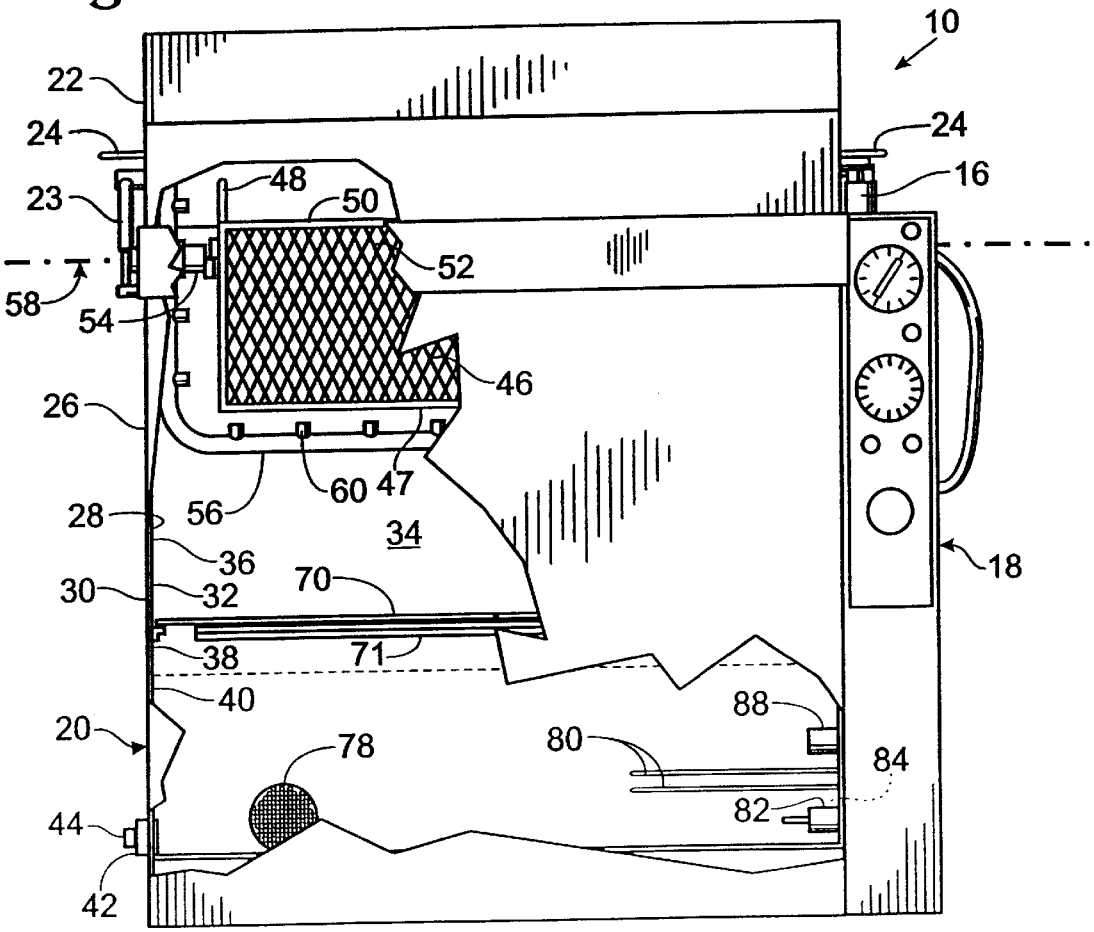
FIG. 2 is a front view of the parts washer shown in FIG. 1 with the cover closed and portions of the housing and the cover broken away.

As shown in FIG. 2, the housing 20 preferably includes an outer shell 26 and an inner shell 28 nested within the outer shell 26. The outer 26 and inner 28 shells cooperate to insulate the parts washer 10. Preferably, the outer 26 and inner 28 shells define an air-filled pocket 30 between the shells and substantially coextensive with the shells. More preferably, the pocket 30 is filled with foam or other suitable insulating material. The housing 20 may also be covered with an insulator, such as ceramic paint. The insulation increases the efficiency of the parts washer 10. The housing 20 is formed of a material that is not attacked by oil, grease, caustic soaps or solvents or similar materials, and does not deform under the parts washer's maximum operating temperature. Examples of such materials are steel and various hardened plastics. Nevertheless, the parts washer 10 may be made without an inner shell 28 or insulation between the inner and outer shells.

The housing 20 includes a washbasin 32 that defines an inner cavity 34 within the parts washer 10. In the preferred embodiment, the washbasin 32 is at least partially coextensive with the inner shell 28. The washbasin 32 may also be formed from the walls of the housing 20 themselves. As shown in FIG. 2, the washbasin 32 includes wall portion 36 and a bottom portion 38. The washbasin 32 is chargeable with a volume of cleaning fluid. The cleaning fluid should be of any suitable composition for removing grease, oil, grime and other residues and contaminants from the parts to be washed. Preferably, the fluid is an aqueous solution of water and an appropriate detergent. Suitable detergents are generally, although not exclusively, alkaline in nature. In some cases, however, it may be desirable simply to use water as the cleaning fluid. An example of a suitable detergent is Armakleen, which is manufactured by Church & Dwight Co.

Figure 5:
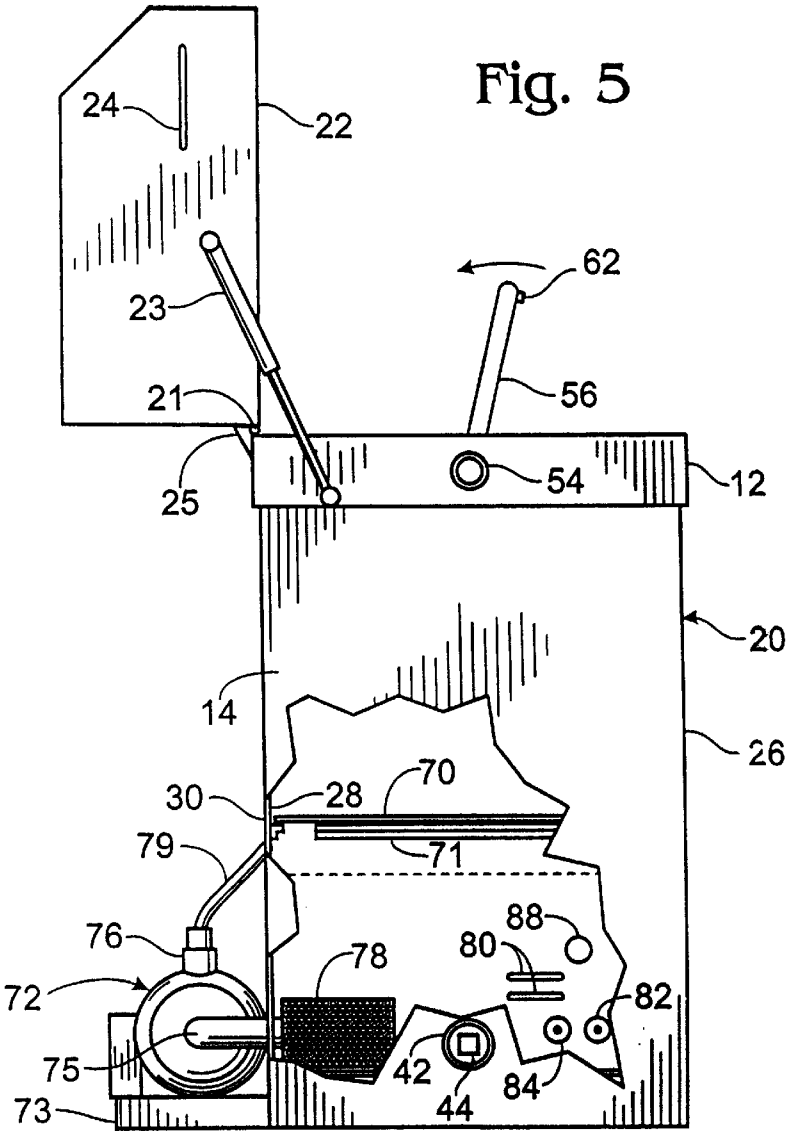
FIG. 5 is a left side view of the parts washer shown in FIG. 1 with the cover open, a portion of the housing broken away and spray tube rotated to a generally upright position.

The parts washer 10 fin-her includes a sump 40 connected to the washbasin 32 for pooling and collecting the cleaning fluid. Preferably the sump 40 is connected to the bottom portion 38 of the washbasin 32. In the preferred embodiment, the sump 40 is integrally formed with the bottom portion 38 of the washbasin 32, as shown in FIGS. 2 and 5. Alternatively, the sump 40 could be positioned adjacent, yet still connected to, the washbasin 32. The sump 40 terminates at a drain 42, which extends through the housing 20 to facilitate the removal of cleaning fluid and debris from the parts washer 10. The drain 42 includes a valve or plug 44 for selectively closing the drain 42, as shown in FIGS. 2 and 5.

Figure 3:
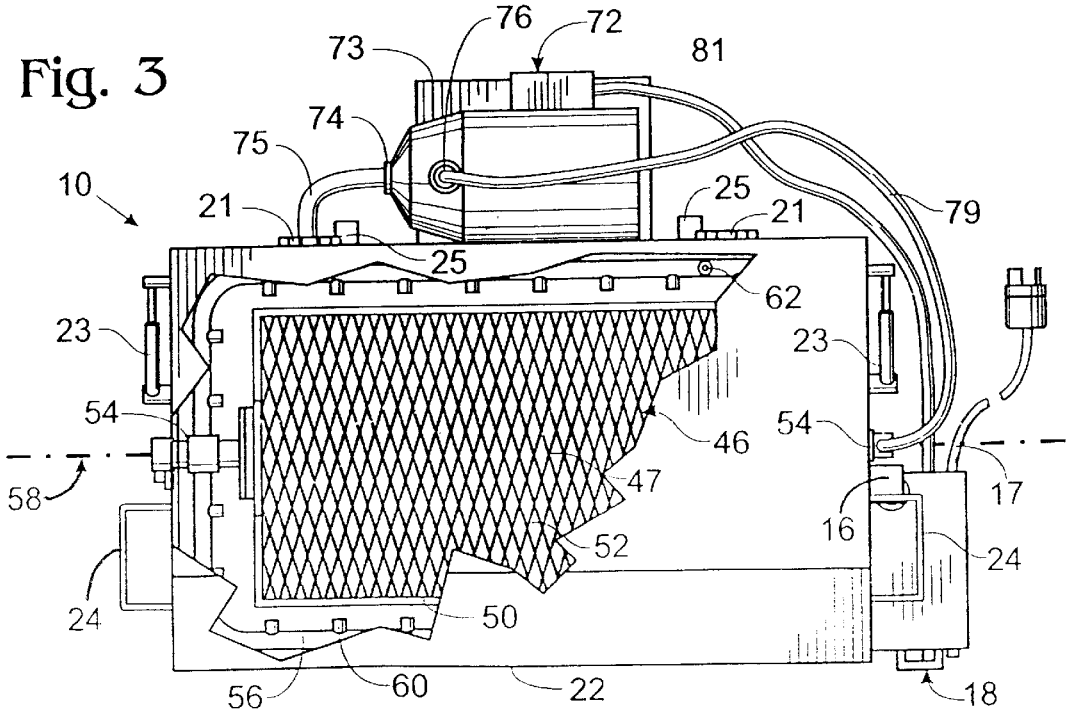
FIG. 3 is a top view of the parts washer shown in FIG. 1 with the cover closed, a portion of the housing broken away and the spray tube rotated to a horizontal position.

As shown in FIGS. 1–3 and 6, a support structure 46 for supporting parts to be washed is positioned within the housing 20. It should be understood that the support structure 46 may be a basket, tray, platform or any other suitable means for supporting parts to be washed. Preferably, the support structure 46 is removably positioned within the housing 20 to facilitate easier loading and unloading of parts to be washed onto the support structure. As shown in FIG. 3, the support structure 46 has a perforated base 47 that allows cleaning fluid to pass through the support structure 46. The perforation or apertures in the support structure 46 should be of sufficient size to allow pieces and particles, which are removed from parts as they are washed, to pass through the support structure 46. The support structure 46 may be constructed of any suitable material having sufficient strength to support parts to be washed without deforming, such as steel. It should be understood that the support structure 46 should be capable of supporting parts weighing several hundred pounds.

As shown, the support structure 46 is a perforated basket comprised of a frame 50 and a lattice 52. The support structure 46 is removably received by plural mounts 54 that are connected to the housing 20. It should be further understood that the invention may be practiced using other single and plural mount systems connected to the housing 20, or that the support structure 46 could simply be placed within the washbasin 32. Other embodiments of the support structure 46 include, but are not limited to, a perforated basket with a perforated lid. This embodiment is particularly useful for washing smaller parts, which otherwise could be lost or removed from the support structure by the force of the cleaning fluid impinging on the parts. Another embodiment of the support structure 46 includes a stand or rack with a series of hooks, aims and/or restraints upon which parts to be washed are positioned.

The support structure 46 further includes handles 48 that facilitate the removal of the support structure 46 from the parts washer 10. The support structure 46 may be loaded with parts to be washed while it is connected to the housing 20. Alternatively, the support structure 46 may be removed from the parts washer 10, loaded with parts to be washed, and subsequently replaced in the parts washer 10.

A spray tube 56 is positioned within, and rotatably coupled to, the housing 20. The spray tube 56 has an axis of rotation 58 and is configured to define a volume of rotation as it rotates about its axis of rotation 58. The spray tube 56 is rotationally coupled to the plural mounts 54 intermediate the housing 20 and the support structure 46 as shown in FIGS. 1–3. Stainless steel, plastic, steel, or any other suitable durable material may be used to form the spray tube 56.

Support structure 46 is substantially within the volume of rotation of the spray tube 56. Preferably, the support structure 46 is completely within the volume of rotation of the spray tube 56. Even more preferably, the spray tube 56 substantially or completely encircles the support structure 46. As shown in FIGS. 1–3, the spray tube 56 has a generally rectangular configuration and completely encircles the support structure 46. Other configurations of spray tube are possible, including, but not limited to, a generally c-shaped or a generally j-shaped spray tube. Other single and plural mount systems are certainly possible that allow the spray tube 56 to rotate about a support structure 46 that is at least substantially within the volume of rotation of the spray tube 56. It should be understood that cross sections of any suitable geometric shape may be used. It should be further understood that, while a horizontally-mounted spray tube 56 is shown in FIGS. 1–3, a vertically-mounted spray tube 56 could also be used, especially with a side load parts washer.

The spray tube 56 includes a plurality of outlets 60 configured to direct fluid substantially toward parts to be washed on the support structure 46. Preferably, the plurality of outlets 60 are spaced along the spray tube 56 to direct fluid at parts to be washed on the support structure 46 from substantially all directions as the spray tube 56 rotates about its axis of rotation 58. Often, the outlets 60 are directed substantially toward the spray tube's axis of rotation 58.

As shown in FIGS. 1 and 5–7, the spray tube 56 further includes at least one outlet 62 on the spray tube 56 configured to direct fluid in a direction to cause fluid-propelled rotation of the spray tube 56 about its axis of rotation 58. Preferably, the spray tube 56 contains at least two outlets 62 on the spray tube 56 configured to direct fluid in a direction to cause fluid-propelled rotation of the spray tube 56 about its axis of rotation 58. This is accomplished by directing fluid generally tangential to the spray tube's 56 axis of rotation 58, thereby causing the spray tube 56 to spin or rotate. As shown in FIG. 5, the expulsion of fluid under pressure from outlets 62 causes the spray tube 56 to spin about its axis of rotation 58 in the direction indicated. It should be understood that the outlets 62 could alternatively be configured to cause fluid-propelled rotation of the spray tube 56 in the opposite direction. This fluid-propelled propulsion eliminates the need for a motor and drive assembly to be used to cause the spray tube 56 to spin or rotate.

The outlets 60 and 62 may be apertures in the spray tube 56. Alternatively, and more preferably, the outlets 60 and 62 are nozzles, spray jets or other suitable fluid-emitting devices that are connected to the spray tube 56. In the preferred embodiment, the direction and rate at which the outlets 60 and 62 direct fluid are adjustable.

The housing 20 includes a strainer 70 connected to the housing 20 below the volume of rotation of the spray tube 56. Preferably, the strainer 70 is substantially coextensive with the support structure 46. The strainer 70 includes a screen or chip tray that allows fluid to pass through, but retains pieces and particles that are removed from parts as they are washed. The strainer 70 is preferably positioned within the parts washer 10 so as to be within a user's reach once the support structure 46 is removed from the parts washer 10. This configuration allows a user to inspect the particles and pieces retained by the strainer 70.

As shown in FIGS. 2 and 5, the strainer 70 is positioned within the housing 20 intermediate the washbasin 32 and the sump 40. The strainer 70 is seated on a shoulder 71, which extends inwardly from the walls 36 of the washbasin 32. It should be understood that the strainer 70 may be positioned at various levels within the housing 20, so long as it is below the field of rotation of the spray tube 56. In alternate embodiments of the invention, the strainer 70 is removably connected to the housing 20 to facilitate the easy removal of the strainer 70 and subsequent inspection of the retained pieces and particles. The strainer 70 may also contain oil-absorbing pads to remove oil, grease, and other contaminants from fluid in the parts washer 10. It is also possible to place oil-absorbing pads in the sump 40 to absorb oils that accumulate in the sump 40.

Figure 6:
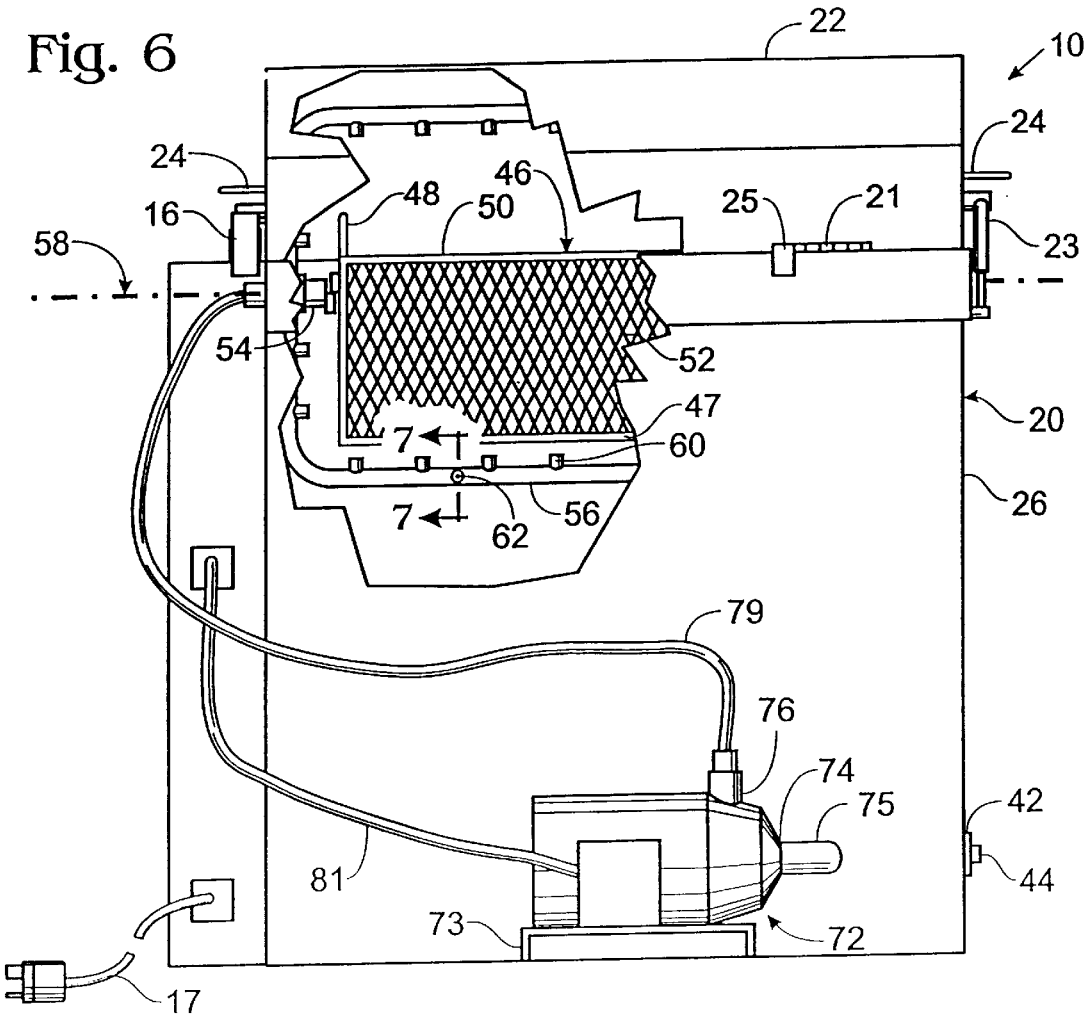
FIG. 6 is a rear view of the parts washer shown in FIG. 1 with the cover closed and portions of the housing and the cover broken away.
Figure 7:
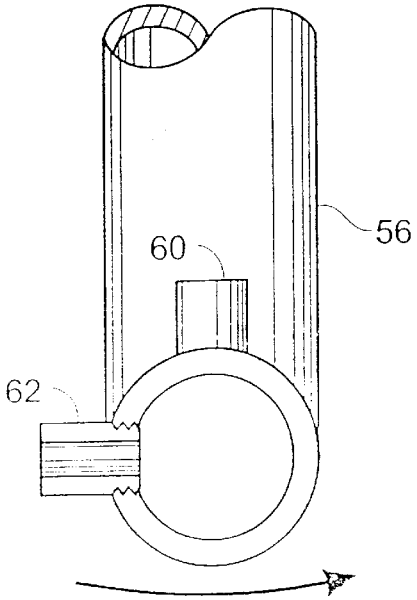
FIG. 7 is a cross-section view of the spray tube taken along line 7—7 in FIG. 6.

The parts washer 10 includes a pump 72 for delivering fluid under pressure to the spray tube 56. As shown in FIGS. 1, 3 and 6, wiring 81 electrically connects the pump 72 to the control panel 18, and member 73 extends from the housing 20 to provide a support for the pump 72 external the housing 20. The pump 72 includes an inlet port 74 for receiving fluid. As shown in FIGS. 3 and 5, the inlet port 74 is connected to the sump 40 by a first hose 75 or other suitable fluid conduit. This enables the pump 72 to intake fluid that has collected in the sump 40, thereby allowing a single charge of fluid to be used throughout a single, or even multiple, wash cycles. In this configuration, the parts washer 10 includes a strainer or filter 78 adjacent the inlet port 74 of the pump 72, as shown in FIGS. 2 and 5. The strainer or filter 78 is made of perforated metal or other suitable material for removing small particulates and other sediments from the cleaning fluid so that the pump 72 is not damaged. In other embodiments of the invention, the inlet port 74 of the pump 72 is connected to a fresh supply of fluid.

Figure 4:
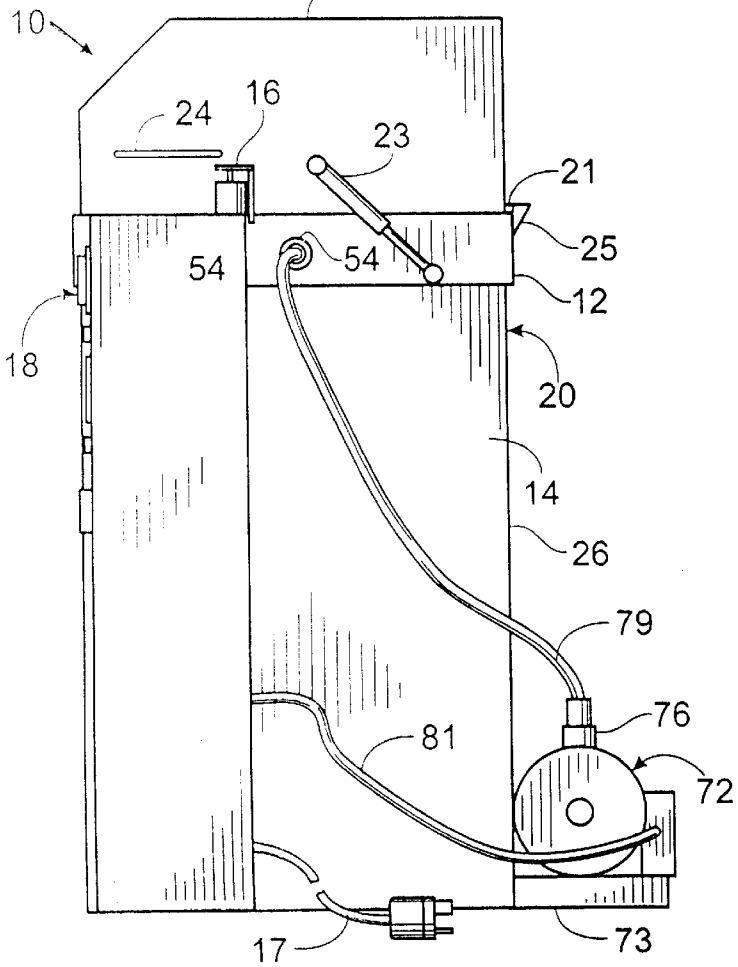
FIG. 4 is a right side view of the parts washer shown in FIG. 1 with the cover closed.

The pump 72 further includes an exit port 76 that is connected to the spray tube 56, as shown in FIGS. 3–5. A second hose 79 or other suitable fluid conduit is used to connect the exit port 76 and the spray tube 56. In use, the pump 72 delivers fluid under pressure through its exit port 76 to the spray tube 56. This fluid is subsequently expelled through the plurality of outlets 60 and 62 on the spray tube 56. Examples of suitable pumps 72 include, but are not limited to, centrifugal, jet, positive displacement and diaphragm pumps. As shown in FIGS. 3 and 6, the pump 72 is positioned external the housing 20 of the parts washer 10. Alternatively, the pump 72 may be contained within the housing 20.

As shown in FIGS. 2 and 5, the parts washer 10 may also contain a heater 80 for heating cleaning fluid within the parts washer 10. The heater 80 may be positioned adjacent the sump 40. Preferably, the heater 80 is at least partially within the sump 40. An example of a suitable heater is a heater with an incoloy-sheathed heating element manufactured by Chromalox, although it should be understood that many other styles and types of heaters are suitable for use in the invented parts washer.

The parts washer 10 may further include plural thermostats 82 and 84, as shown in FIGS. 2 and 5. The first thermostat 82 is configured to measure the temperature of fluid within the parts washer 10 and automatically disengage the heater 80 if the temperature of the fluid exceeds a defined maximum temperature. The first thermostat 82 preferably is positioned to measure the temperature of fluid in the sump 40. Alternatively, the first thermostat 82 could be positioned to measure the temperature of fluid in the parts washer 10 indirectly by measuring the temperature of the housing 20, washbasin 32 or sump 40. In operation, the first thermostat 82 is an automatic safety shut-off that protects the parts washer 10 from damage and deformation that would be caused if the cleaning fluid was heated above a defined maximum temperature. For most aqueous cleaning solutions, the defined maximum temperature is approximately 200° F. It should be understood that the defined maximum temperature may vary depending on the particular materials of construction used in the parts washer 10 and the composition of the cleaning fluid.

The second thermostat 84 is configured to control the heater 80 to maintain the temperature of the fluid between defined upper and lower temperatures. Preferably, the second thermostat 84 is positioned to measure the temperature of fluid in the sump 40. The second thermostat 84 maintains the temperature of the cleaning fluid within a defined temperature range while the parts washer 10 is in use. For most aqueous cleaning solutions, the defined temperature range is approximately 150–195° F. It should also be understood that temperatures outside of this range may be acceptable, depending on the particular materials of construction used in the parts washer 10 and the composition of the cleaning fluid. It should also be understood that the first and second thermostats 82 and 84 could use a common sensing element to measure the temperature of fluid in the parts washer 10.

The parts washer 10 may further include a pressure switch 88 for disengaging the pump 72 and the heater 80 if pressure from fluid in the parts washer 10 is less than a defined minimum pressure. The pressure switch 88 is an automatic safety shut-off that protects the parts washer 10, and especially the pump 72 and heater 80, from damage caused if the parts washer 10 is operated without a sufficient volume of cleaning fluid. In the preferred embodiment, the pressure switch 88 is a static pressure switch and measures the pressure of fluid within sump 40. It should be understood that if the pressure switch 88 is used in an embodiment of the parts washer 10 that does not contain a heater 80, then the pressure switch 88 merely disengages the pump 72 if the pressure of fluid in the parts washer 10 is less than a defined minimum pressure. All of the electrical components described above, including the thermostats, pressure switches, pumps, safety valves and heaters, may be electrically wired in any known manner.

Another embodiment of the invention is a parts washer that includes the previously described first and second thermostats 82 and 84 and pressure switch 88. The parts washer further includes the previously described housing 20, support structure 46 and pump 72. In this embodiment, the parts washer has a fluid-emitting apparatus configured to direct fluid toward parts to be washed on the support structure 46. This fluid-emitting apparatus may be any suitable apparatus for receiving fluid under pressure from the pump 72 and directing that fluid substantially toward parts to be washed on the support structure 46.

Alternate embodiments of the invented parts washer are shown in FIGS. 8–11. These embodiments contain, for the most part, the same elements and subelements as the previously described embodiments.

Figure 8:
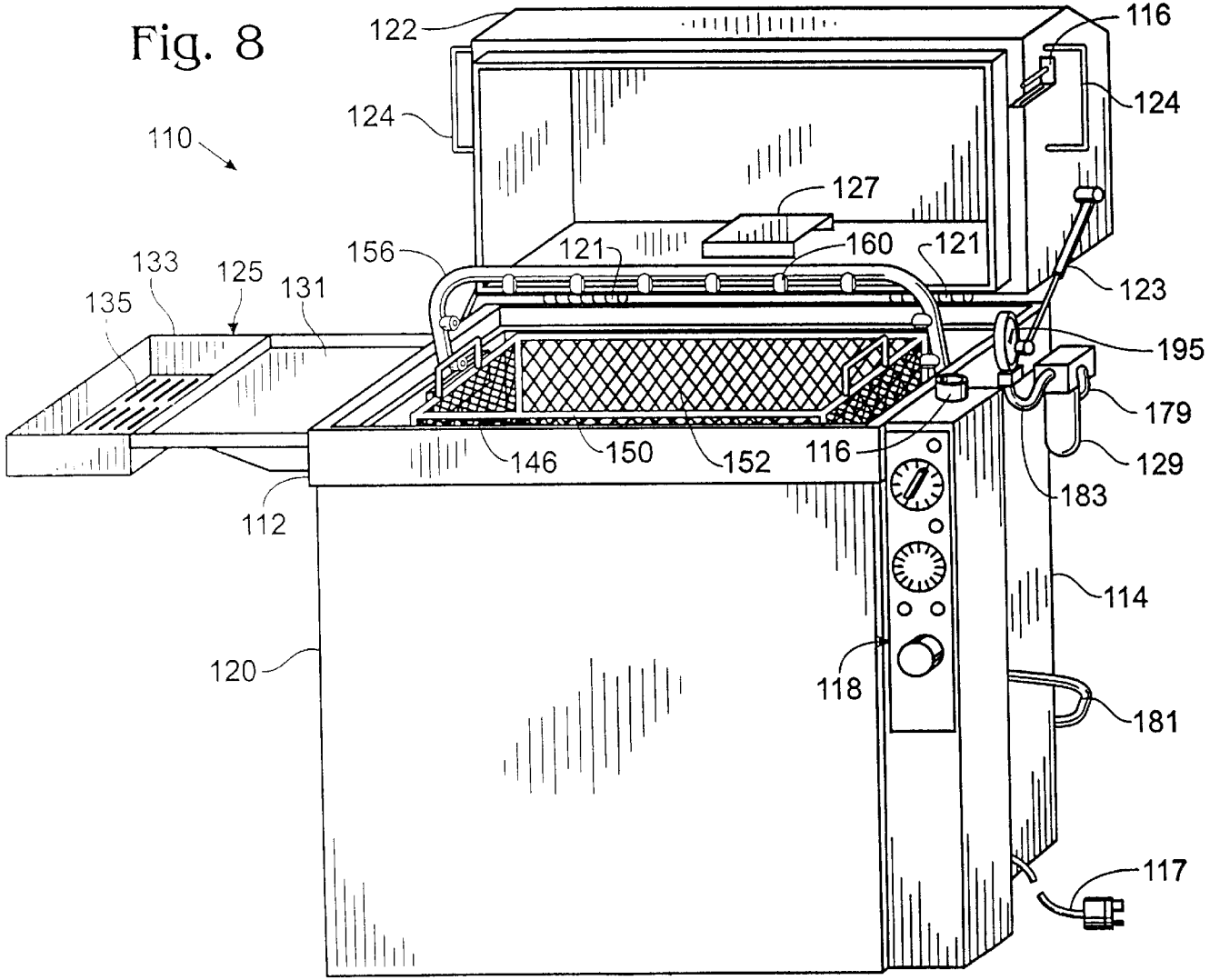
FIG. 8 is an isometric view of an alternate embodiment of the invented parts washer with the cover open and the spray tube rotated to an upright position.
Figure 10:
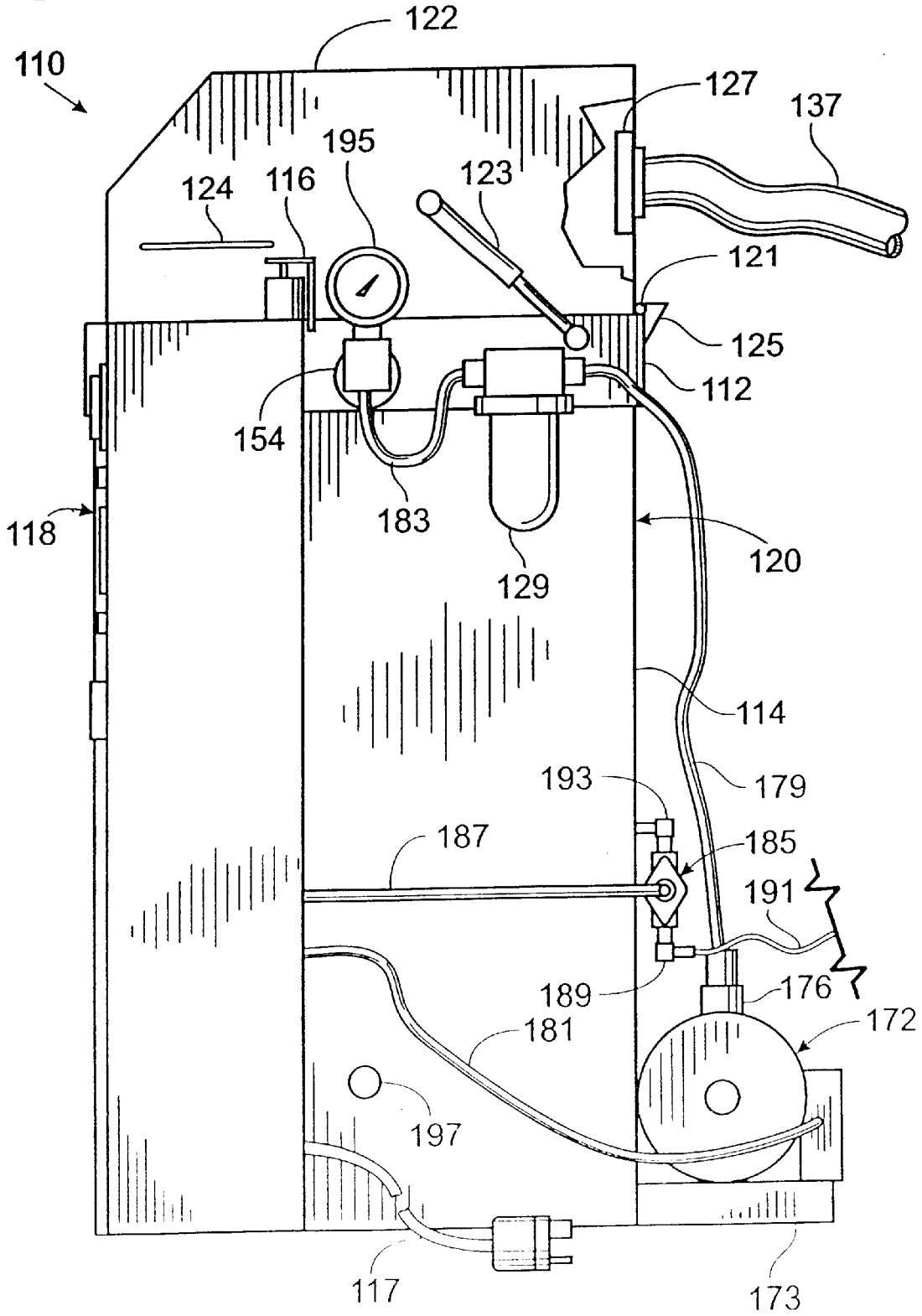
FIG. 10 is a right side view of the parts washer shown in FIG. 8 with the cover closed and a portion of the cover broken away.

In FIGS. 8–10, a parts washer is generally indicated at 110 and includes top and side regions 112 and 114, respectively. The parts washer 110 has a housing 120 that includes a cover 122. The cover 122 is connected to the housing 120 by a pair of hinges 121 and is opened and closed using handle portions 124. A pair of hydraulic struts 123 and cover supports 125 (FIG. 11) stabilize and support the cover 122 when it is raised to an open position. The housing 120 includes a control panel 118 mounted on the side region 114 of the housing 120 and connected to a power supply by power cord 117. A solenoid safety latch 116 is connected to the housing 120 and the cover 122.

The parts washer preferably includes outer and inner shells 126 and 128, which define pocket 130. The housing 120 includes a washbasin 132 that defines an inner cavity 134 within the parts washer 110. The washbasin includes walls 136 and bottom portion 138 and is chargeable with a volume of fluid. The parts washer 110 further includes a sump 140, a strainer 170 seated on a shoulder 171 extending outwardly from the housing 120, a pump 172 seated on a member 173 and having an inlet port 174 and an exit port 176, first and second hoses 175 and 179, wiring 181, a drain 142 and a valve 144.

A support structure 146 for supporting parts to be washed is removably seated on plural mounts 154. A spray tube 156 is positioned within the housing 120 and rotatably coupled to the plural mounts 154 intermediate the support structure 146 and the housing 120. The spray tube 156 contains a plurality of outlets 160.

The plurality of outlets on 160 on the spray 156 are configured to direct fluids substantially toward parts to be washed on the support structure 146 and to cause fluid-propelled rotation of the spray tube 156 about its axis of rotation 158. As shown in FIG. 11, the plurality of outlets 160 are radially offset from the plane of the spray tube 156 by approximately 10°. This facilitates the plurality of outlets 160 both to wash parts on the support structure 146 and to cause fluid-propelled rotation of the spray tube 156 about its axis of rotation 158. It should be understood that the invention may be practiced using larger or smaller degrees of offset, so long as the plurality of outlets 160 are still able to wash parts on the support structure 146 as well as to cause fluid-propelled rotation of the spray tube 156 about its axis of rotation 158. Additionally, it would also be possible to provide a spray tube containing the radially offset plurality of outlets 160 as well as at least one outlet configured primarily to cause fluid-propelled rotation of the spray tube about its axis of rotation.

As shown in FIG. 8, the parts washer 110 further includes a service tray 125, a baffle 127 and a filtration system 129. The service tray 125 is connected to the top region 112 of the housing 120. Service tray 125 includes a tray region 131 and a basket region 133. Preferably, the basket region has a perforated bottom 135. The service tray 125 is used for inspecting and drying parts, as well as for providing a convenient depository for hand tools that may be used to adjust the parts washer 110 or to scrub burned on or encrusted deposits on parts on the support structure 146.

Baffle 127 is removably connected to the cover 122 of the parts washer 110. As shown in FIG. 10, baffle 127 may be coupled with an exhaust pipe 137 to provide a hot air exhaust system for the parts washer 110.

The filtration system 129 removes very fine debris and solids from fluid as it is pumped to the spray tube 156. This additional filtration extends the life of fluid used in the parts washer 110 and reduces the possibility of fouling or clogging the spray tube 156 or the plurality of outlets 160 on the spray tube 156. As shown, the filtration system 129 receives fluid under pressure from the second hose 179, which is connected to the exit port 176 of the pump 172. The filtration system 129 includes filters that remove dirt and debris from the fluid. Preferably, the filtration system 129 includes stainless steel strainer filters that remove debris and solids as small as 50 microns. Fluid under pressure passes through the filtration system 129 to the spray tube 156 via a third hose 183 or other suitable fluid conduit that connects the filtration system 129 and the spray tube 156. As shown, the filtration system 129 is mounted external the top region 112 of the parts washer 110. This facilitates easy removal and cleaning of the filtration system 129.

As shown in FIG. 10, the parts washer may further include an automatic water fill 185. As shown, the automatic water fill 185 is electrically connected to the control panel 118 by cable 187. The automatic water fill has an inlet 189 that is connected to a supply of fluid (not shown) by a fourth hose 191. The automatic water fill 185 further includes an exit 193 that extends through the housing 120 of the parts washer 110, thereby facilitating the addition of fluid to the parts washer 110. Preferably, the exit 193 delivers fluid to the sump 140 of the parts washer 110. The automatic water fill 185 is activated by the pressure switch 88. By automatically adding fluid to the parts washer 110, the automatic water fill 185 eliminates the need to turn off the parts washer 110 if the level of fluid drops below a defined minimum level while the parts washer 110 is in use.

As shown in FIG. 10, the parts washer 110 includes a pressure gauge 195 and a temperature gauge 197. The pressure 195 and temperature 197 gauges display the pressure and temperature, respectively, of fluid in the parts washer 110. As shown, the temperature gauge 197 is mounted on the side region 114 of the parts washer 110 and directly or indirectly measures the temperature of fluid in the parts washer 110. The pressure gauge 195 is mounted to the top region 112 of the housing 120 and measures the pressure of fluid being delivered to the spray tube 156. It should be understood that many other suitable locations exist where the pressure gauge 195 and the temperature gauge 197 can be mounted to respectively measure and display the pressure and temperature of fluid in the parts washer 110.

It should be further understood that the previously described service tray 125, baffle 127, filtration system 129, spray tube 156, automatic water fill 185, pressure gauge 185 and temperature gauge 197 may all be incorporated into the embodiment of the invented parts washer shown in FIGS. 1–7.

Another embodiment of the invented parts washer is shown in FIGS. 12–18. Unless indicated otherwise, the embodiment includes the same elements and sub-elements as the previously described embodiments, and for the sake of brevity, detailed descriptions of those elements and sub-elements will not be repeated.

Figure 12:
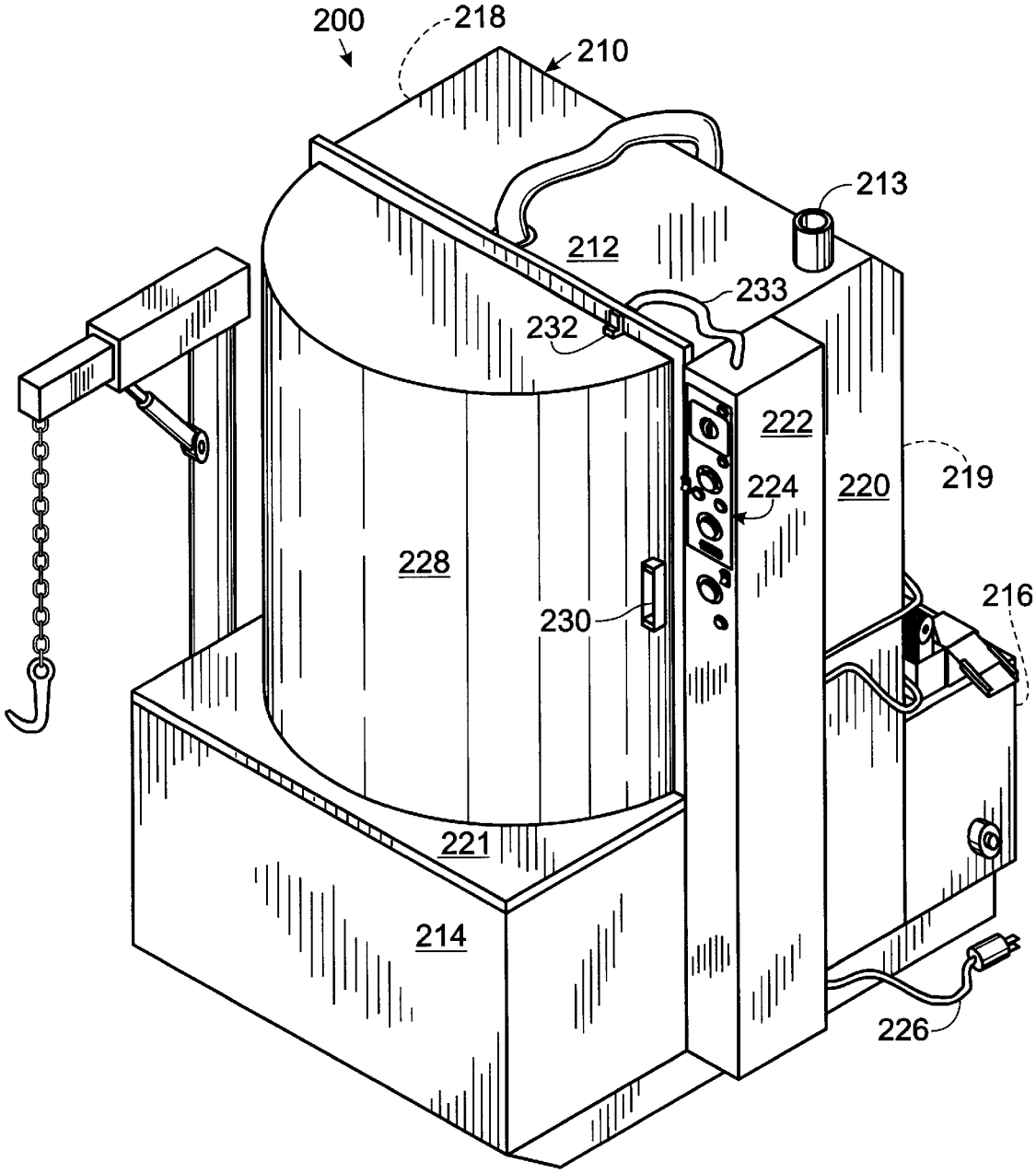
FIG. 12 is an isometric view of a parts washer constructed in accordance with an alternate embodiment of the invention.

In FIG. 12, the parts washer is generally indicated at 200 and has a housing 210, which includes a top portion 212 with an exhaust vent 213, front and rear portions 214 and 216, side walls 218 and 220, and rear wall 219. Washer 200 further includes a cover plate 221 adjacent front portion 214 and a control panel 222 mounted on side wall 220. Control panel 222 includes various controls and indicators 224, and is connected to a power supply (not shown) by a power cord 226.

A revolving door 228 is rotatably mounted on housing 210 and extends generally upwardly from front portion 214. Door 228 has a semi-cylindrical configuration and includes a handle 230 and a solenoid safety latch 232, which prevents the door from being opened while the washer is in use. Latch 232 is connected to control panel 222 by a power cord 233. When door 228 is closed, as shown in FIG. 12, it defines the forward boundary of the washer's wash chamber or washbasin 234, which is shown in FIG. 13.

Figure 13:
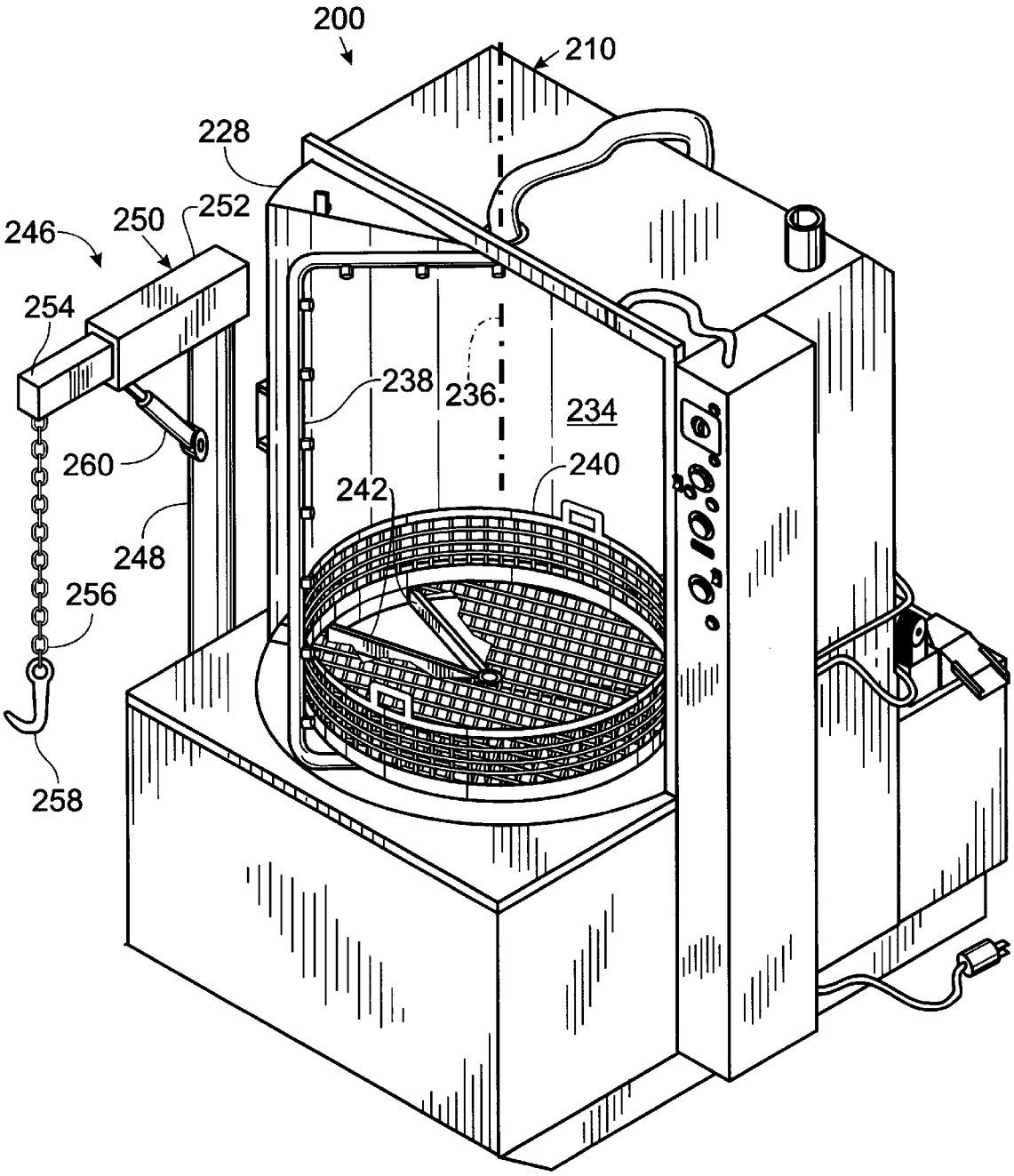
FIG. 13 is an isometric view of the parts washer shown in FIG. 12, with the door rotated to an open position.

As shown in FIG. 13, door 228 may be opened by rotating it about a vertical axis 236 to permit objects to be loaded into and removed from the parts washer. Door 228 is contained within housing 210 as it is rotated from the closed position shown in FIG. 12 to an open position, such as is shown in FIG. 13, and therefore rotates within an approximately 180° path. It should be understood that other configurations of doors are possible, as long as they are selectively positionable between a closed position, in which the parts washer's washbasin or wash chamber is enclosed, and an open position, in which parts may be placed into or removed from the parts washer.

Also shown in FIG. 13 are the parts washer's spray tube 238, which is rotatably mounted on housing 210 about axis of rotation 236, and the parts washer's removable support structure 240. Structure 240 is similar to the previously described support structures, however as shown in this embodiment, it has a generally cylindrical configuration and includes a plurality of radially spaced lower supports 242.

Also shown in FIGS. 12 and 13 is a hoist, which is generally indicated at 246 and is used to assist the loading of heavy or otherwise cumbersome objects into the parts washer, as well as their subsequent removal therefrom. Hoist 246 is pivotally mounted on housing 210 and includes a generally vertical support 248. A pivot arm 250 is pivotally connected to the upper portion of support 248 and includes telescoping outer and inner members 252 and 254, respectively. A chain 256 or other suitable supporting device, such as cords or straps, is adjustably and removably coupled to the end of inner member 254 distal support 248. Chain 256 includes a hook 258 or other mechanism for engaging parts to be loaded or unloaded. Hoist 246 further includes a hydraulic cylinder 260 which is pivotally connected to pivot arm 250 and support 248 and controls the angle at which pivot arm 246 extends with respect to support 248. It should be understood that cylinder 260 is controlled, i.e. used to increase or decrease the angle of the pivot arm with respect to the support, via any conventional mechanism. Hoist 246 pivots or rotates with respect to the housing to transport supported parts between a position external the parts washer and a position generally within wash chamber 234 and above support structure 240. Hoist 246 is shown positioned on one side of the parts washer, but it may be positioned in different locations, or placed adjacent the parts washer.

Figure 14:
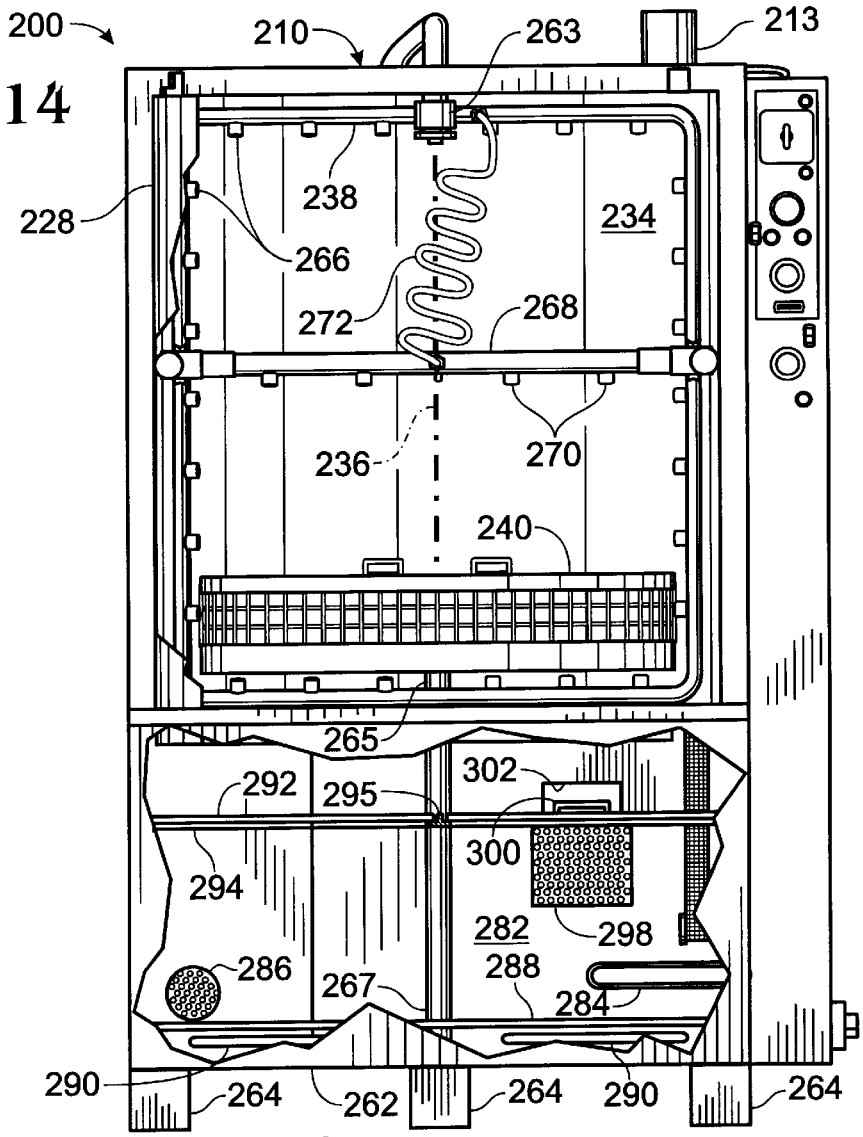
FIG. 14 is a front elevational view of the parts washer shown in FIG. 12, with the door open, a portion of the housing broken away and the hoist removed.

FIG. 14 is a front elevational view of the parts washer shown in FIGS. 12 and 13, with hoist 246 removed and a section of the housing's front portion 214 and door 228 removed to show details of internal construction. As shown, parts washer 200 is supported on a plurality of laterally spaced skids 264 which elevate the parts washer above the surface on which it is rested. The spacing of skids 264 enables a fork lift or other suitable device to be used to lift and transport the parts washer. It should be understood that it is meant to be within the scope of the present invention that the parts washer could include other forms of support devices, such as casters or other wheeled devices, or adjustable and non-adjustable legs. Alternatively, the parts washer could contain no additional supports, but it is preferable that some form of elevational support is used to facilitate the transportation of the parts washer by a fork lift or other device.

As shown in FIG. 14, door 228 and spray tube 238 are rotatably mounted on housing 210 by an upper mount 263 and a lower mount 265. Lower mount 265 has a lower portion 267 which extends upwardly from lower surface 262 to provide a rigid structural support that is capable of supporting the weight of the door, spray tube and support structure, as well as the significant weight of the parts to be washed. The mounts are vertically aligned and enable the rotating movement of the door, spray tube and support structure about axis of rotation 236. As discussed above, support structure 240 is preferably removably mounted on lower mount 265 so that the structure may be selectively removed from the parts washer when it is desirable to use structure 242 to transport parts, either prior to or subsequent to the parts being washed. It should also be understood that support structure 240 may be rotated about lower mount 265, however, when the parts washer is in use, it is primarily only the spray tube which will rotate.

Figure 15:
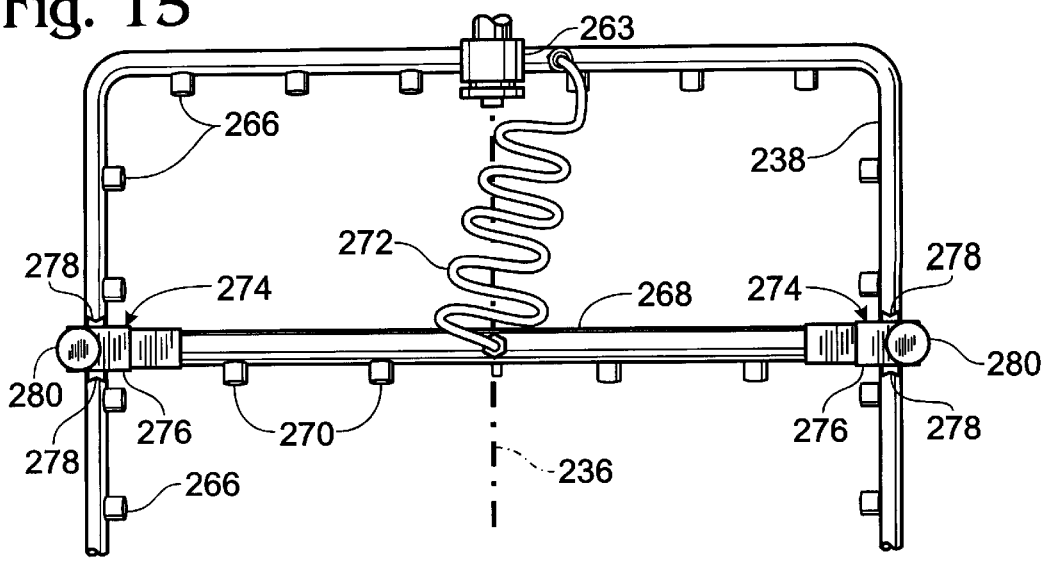
FIG. 15 is an enlarged, fragmentary detail showing a portion of the spray tube of the parts washer shown in FIG. 14, with the auxiliary spray tube mounted in a higher position on the spray tube.

Spray tube 238 forms a continuous loop which defines a volume of rotation that completely encloses support structure 240 as spray tube 238 rotates about axis of rotation 236. Spray tube 238 includes a plurality of outlets 266 which are configured to direct fluid substantially toward parts to be washed on the support structure. At least one, and preferably all, of the outlets are further configured to direct fluid in a direction to cause fluid-propelled rotation of the spray tube about its axis of rotation. As shown in FIG. 15, the outlets on opposing sides of axis 236 are inclined or angled in opposite directions with respect to a plane defined by the perimeter of the spray tube. This offset relationship of outlets 266 causes the spray tube to rotate about it axis of rotation as fluid is expelled through the outlets.

Also shown in FIGS. 14 and 15 is an auxiliary spray tube 268 with a second plurality of outlets 270. Auxiliary spray tube 268 is adjustably and removably mounted on spray tube 238 and receives fluid from a conduit 272 that is coupled to both of the spray tubes to allow fluid to flow therebetween. The second plurality of outlets may be configured similar to the previously described outlets 266 on spray tube 238, in that they each direct fluid substantially toward parts to be washed on a support structure and also direct fluid in a direction to cause fluid-propelled rotation of the spray tube about its axis of rotation. Alternatively, outlets 270 may extend vertically downward from auxiliary spray tube 268. Because auxiliary spray tube 268 is adjustably mounted on spray tube 238, it may be selectively positioned along the length of spray tube 238 to position outlets 270 in a closer relationship to parts to be washed on support structure 240. This selected positioning of the auxiliary spray tube enables fluid to be directed specifically at particular parts or regions to be washed from a relatively close range to provide more thorough and quicker cleaning of the parts.

As shown in FIGS. 14 and 15, auxiliary spray tube 268 is coupled to spray tube 238 by a pair of adjustable clamps 274. Each clamp 274 includes a pair of engagement surfaces 276 for engaging or otherwise gripping spray tube 238. As shown, surfaces 276 include teeth 278 that grip tube 238. It should be understood that clamps 274 are symmetrical with respect to each side of the spray tube, and therefore engagement surfaces 276 include teeth on both sides of the spray tube. Each clamp 274 also includes a knob 280 or other suitable device for causing the engagement surfaces to selectively grip and release spray tube 238.

The parts washer's wash chamber 234 further includes a sump 282 beneath the spray tubes and support structure, as shown in FIG. 14. Sump 282 is chargeable with a volume of cleaning fluid and includes at least one heater 284, such as an electric, gas or propane heater, for heating the cleaning fluid, and a filter 286 for preventing small particulates and other sentiments from being drawn into the parts washer's pump, which will be discussed subsequently.

Sump 282 has a lower surface 288 beneath which an evaporator is operatively mounted. The evaporator includes a plurality of heating elements 290 which are used to evaporate the cleaning fluid in sump 282. Upon actuation of the evaporator, heating elements 290, which are disposed beneath sump 282 and therefore are preferably not in contact with the fluid, heat the sump's lower surface 288, which in turn heats the fluid in the sump to its boiling point. As the fluid is evaporated or vaporized, it exits out of the parts washer through exhaust vent 213. The evaporator is used to reduce the volume of fluid in the sump. Preferably, all or substantially all of the fluid is evaporated. Therefore, instead of having to dispose of the entire volume of fluid, all one needs to dispose of is the particulate, dirt and other material which was removed from the parts as they were washed.

Sump 282 is separated from the rest of wash chamber 234 by a plurality of plates 292. Plates 292 are supported in an elevated position above the lower surface 288 of the sump by a brace 294 and are configured to collectively form a generally planar surface for catching larger objects which are removed from parts as they are washed. As shown, brace 294 supports the perimeter of each plate 292 and includes a spacer 295 that extends between adjacent plates. Plates 292 are removable to allow access to the sump. Plates 292 also act as a cover for sump 282 to prevent the accidental dropping of parts into the sump.

Figure 16:
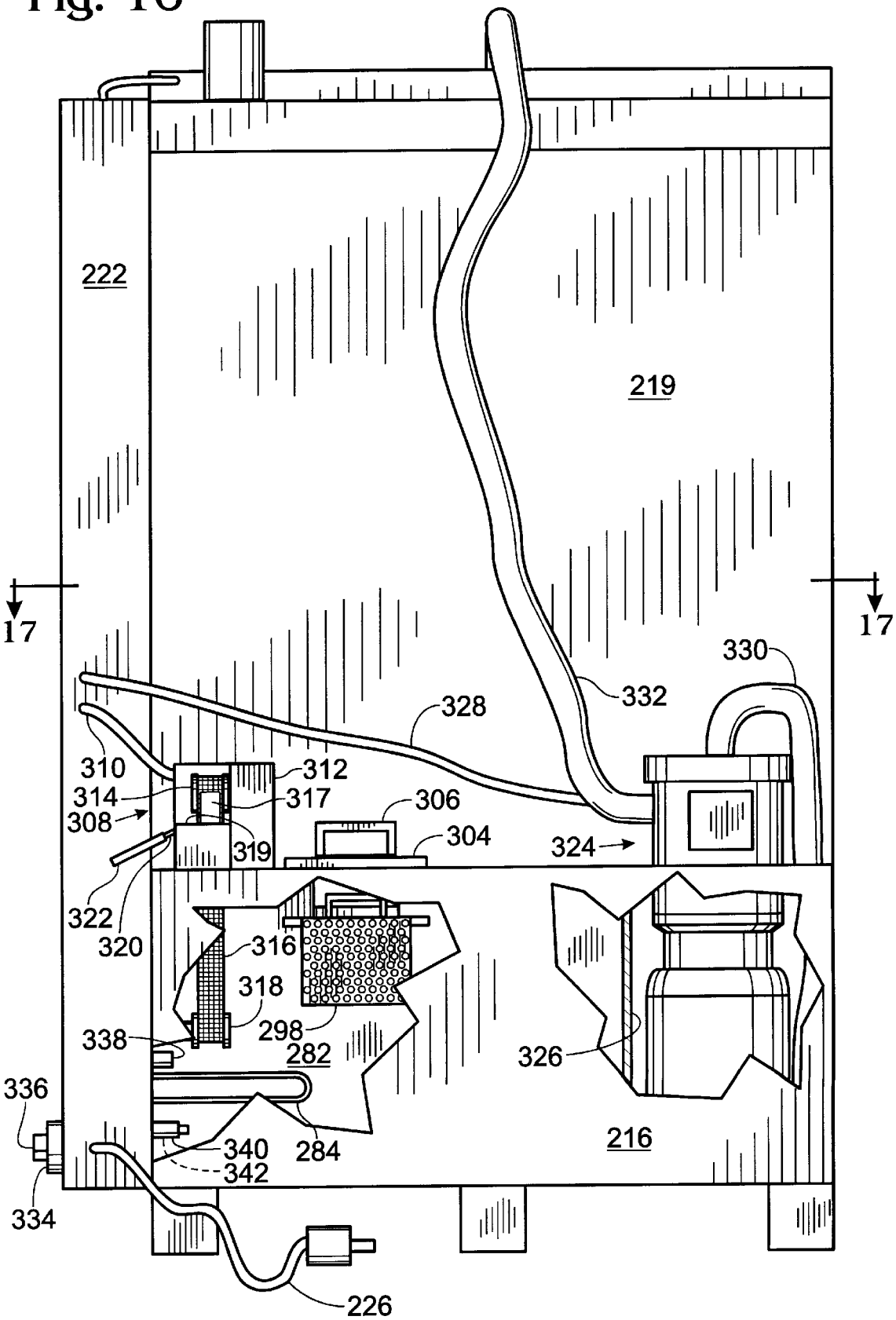
FIG. 16 is a rear elevational view of the parts washer shown in FIG. 12, with a portion of the housing broken away to show details of internal construction.
Figure 17:
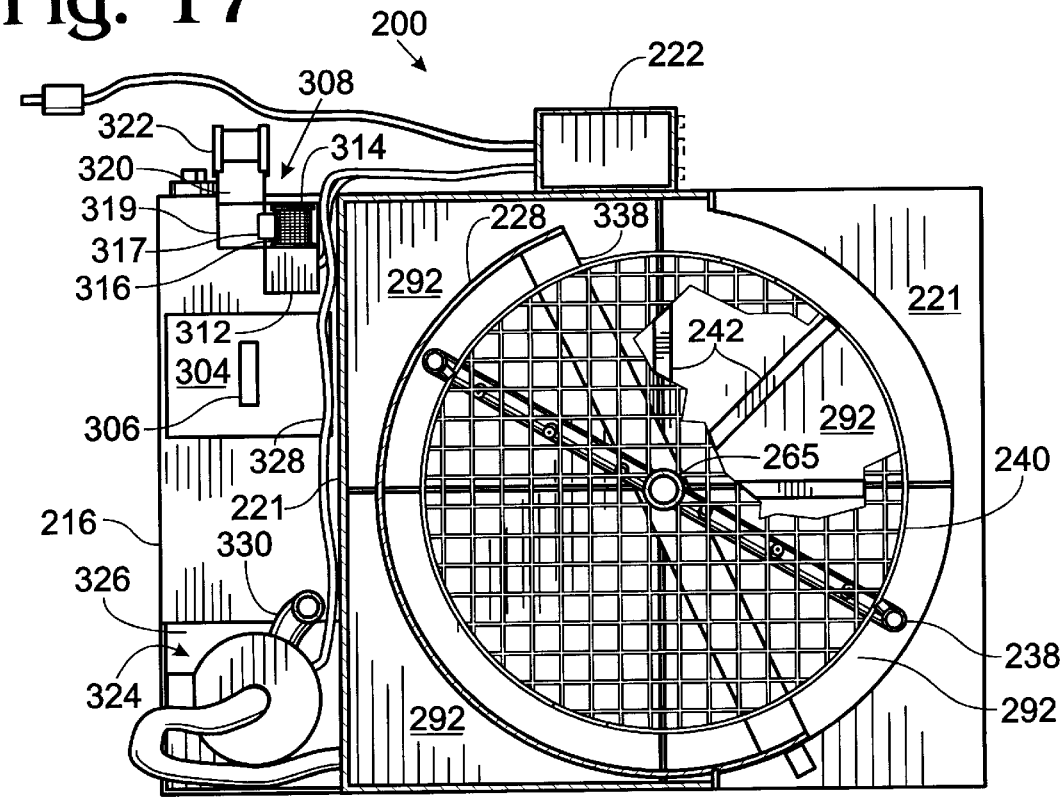
FIG. 17 is a fragmentary cross-sectional view taken along the line 17—17 in FIG. 16.

As shown in FIGS. 14 and 16, the parts washer further includes a strainer 298 in the form of a perforated basket with a handle 300. Strainer 298 is mounted adjacent the rear portion of the parts washer, and is substantially within sump 282. As shown, fluid dispensed by outlets 266 and 270 passes through support structure 240 and onto plates 292. The fluid subsequently flows along plates 292 through an aperture 302 in a downwardly extending portion of rear wall 219 of the wash chamber above sump 282 and strainer 298. The fluid and any particles and objects transported thereby subsequently passes through strainer 298 and into sump 282. Preferably, plates 292 are supported in a slightly inclined orientation to facilitate the flow of dispensed fluid into strainer 298. As shown in FIGS. 16 and 17, rear portion 216 includes a lid 304 with a handle 306 that may be removed to enable strainer 298 to be removed from the parts washer. Once removed, strainer 298 enables the parts and debris retained therein to be inspected by a user or simply discarded.

Also shown in FIGS. 16 and 17 is an oil skimmer, which is generally indicated at 308 and which is used to remove oil, grease and other floating substances from the fluid contained in sump 282. Skimmer 308 is connected to control panel 222 by a power cord 310 and includes a motor 312 drivingly engaging an upper spool or gear 314 which is rotatably coupled to the motor. An articulated or otherwise flexible belt 316 extends around upper spool 314 and a lower spool 318, which is rotatably mounted in sump 282. It should be understood that as motor 312 causes upper spool 314 to rotate, belt 316 travels around a path defined by the upper and lower spools. Belt 316 should be constructed of any suitable material to which grease and oils will adhere, such as stainless steel, so that the grease and oils will be drawn out of the fluid in the sump as the belt rotates along its path. Skimmer 308 further includes a scraper 317 adjacent belt 316 which removes or scrapes adhered grease and oils from belt 316 after they are drawn out of the fluid. The removed grease and oils flow along scraper 317 to a platform 319, and ultimately are disposed of as they flow down a chute 220 into a receptacle (not shown). As shown, chute 320 further includes an adjustable end portion 322 which enables the discharge location of the removed oils and grease to be better controlled.

The parts washer also includes a pump 324, which is shown in FIGS. 16 and 17. Pump 324 is mounted within a pocket 326 formed in the rear portion 216 of the housing. Pump 326 is connected to control panel 322 by a power cord 328 and includes an inlet tube 330 through which fluid is received from sump 282. The pump further includes an outlet tube 333 through which fluid is delivered under pressure to spray tubes 238 and 268. Any suitable pump may be used.

As shown in FIG. 16, parts washer 210 includes a drain 334 which is connected to sump 282 and enables fluid to be removed from the sump. Drain 334 is shown as a valve with a stopper 336 that may be removed to enable fluid to flow out of the drain. It should be understood that the drain may not need to be used when the previously described evaporator is used to remove the fluid from the parts washer. Also shown in FIGS. 16 and 18 are a pressure switch 338 and first and second thermostats 340 and 342, which function as previously described.

In FIG. 17, the radial alignments of door 228, spray tube 238 and support structure 240 are shown. Also shown is an elongate member 338 which extends between opposed sides of door 228 to provide additional structural support to the door.

Figure 18:
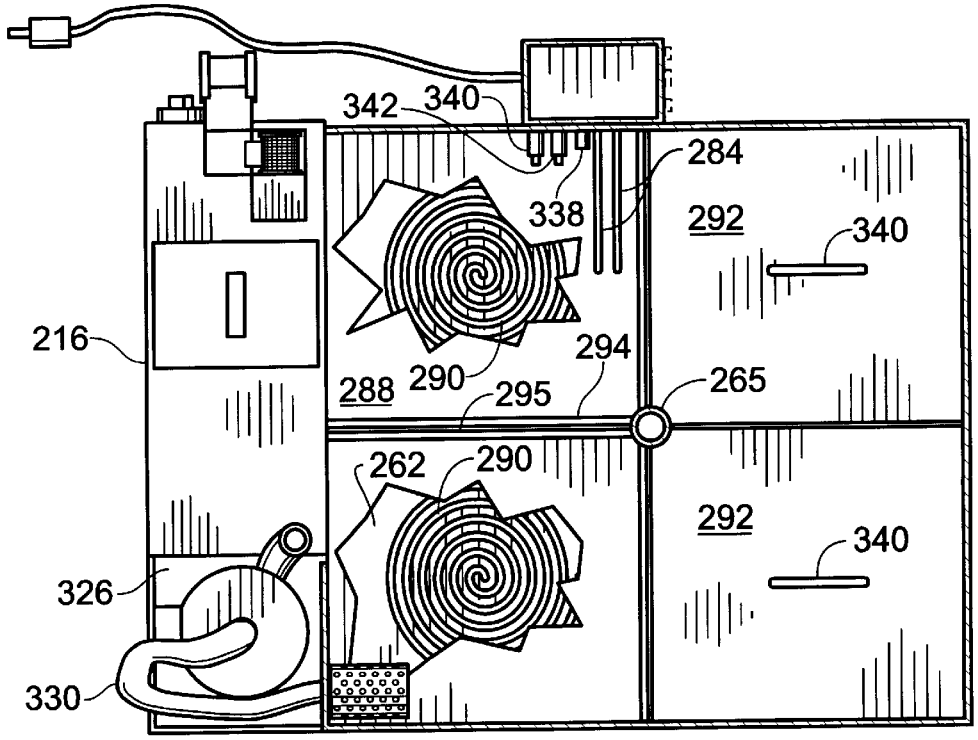
FIG. 18 is the view shown in FIG. 17 with the cover plate, the spray tube, door, support structure and two plates removed, and a portion of the housing broken away.

FIG. 18 is taken from the same viewpoint as FIG. 17, only with door 228, spray tube 238, support structure 240, and cover plate 221 removed. In FIG. 18, two plates 292 and their orientation are shown on the right. Two similar plates typically are positioned on the left, but have been removed to show lower surface 288 of the sump and heaters 284. Plates 292 include handles 340 which enable the plates to be selectively removed from the parts washer. The lower surface 228 of the sump has been partially broken away to reveal heating elements 290, which form a portion of the parts washer's evaporator. It should be understood that the number and placement of the heating elements and heaters will vary, depending on the size of the parts washer and the volume of fluid contained therein.

Method of Using the Invention

To use the parts washer 10 shown in FIG. 1, the parts washer 10 is first charged with a volume of fluid. The fluid should be selected based on the type and condition of the parts to be washed. Next, parts to be washed are loaded onto the support structure 46. The fluid is then received into the pump 72 through the pump's inlet port 74. The pump 72 subsequently delivers fluid under pressure through its exit port 76 to the spray tube 56. The fluid under pressure is next sprayed from the outlets 60 on the spray tube 56 substantially toward the parts to be washed on the support structure 46 and emitted from at least one outlet 62 on the spray tube 56 to cause fluid-propelled rotation of the spray tube 56 about its axis of rotation. This results in fluid being directed at parts to be washed on the support structure 46 from substantially all directions.

A variation of the method may include the step of removing the support structure 46 from the parts washer 10 prior to loading parts to be washed onto the support structure 46. This enables the support structure 46 to be carried to the parts to be washed. This is especially convenient when the parts to be washed are not all centrally located. After loading the parts to be washed, the support structure 46 is replaced into the parts washer 10.

It should be understood that the embodiments of the parts washer shown in FIGS. 8–11 may be used by following the method described above, however the plurality of outlets are configured to direct fluid substantially toward parts to be washed on the support structure and to direct fluid in a direction to cause fluid-propelled rotation of the spray tube about its axis of rotation.

Similarly, the parts washer shown in FIGS. 12–18 may be used by following either of the methods described above, depending on the number and orientation of outlets on the spray tube. The parts washer may focus spray on parts by adjusting auxiliary spray tube 268, as discussed. This parts washer also facilitates the washing of larger parts due to its front loading, its hoist, and its size.

Industrial Applicability

The invented parts washer and method are applicable in any situation where mechanical parts or equipment need to be cleaned. It is particularly applicable for washing industrial or automotive parts.

While the preferred embodiments of the invented parts washer and method have been disclosed, changes and modifications can be made without departure from the spirit of the invention.

We claim:

1. A parts washer for washing parts, comprising:

a housing having a wash chamber;

a primary spray tube for receiving fluid under pressure from a pump, wherein the primary spray tube is rotatably coupled to the housing, has an axis of rotation and is configured to define a volume of rotation as it rotates about its axis of rotation;

a support structure configured to support parts to be washed, wherein the support structure is positioned within the housing and is at least substantially within the volume of rotation of the spray tube;

a plurality of outlets on the spray tube configured to direct fluid substantially toward parts to be washed on the support structure;

an auxiliary spray tube selectively portionable along the length of the primary spray tube and having a second plurality of outlets configured to direct fluid substantially toward parts to be washed on the support structure; and at least one outlet on one of the spray tubes configured to direct fluid in a direction to cause fluid-propelled rotation of the spray tubes as a unit about the axis of rotation.

2. The parts washer of claim 1, wherein the support structure is the volume of rotation of the spray tube.

3. The parts washer of claim 1, wherein the primary spray tube substantially encircles the support structure.

4. The parts washer of claim 1, wherein the pluralities of the outlets on the spaced along their respective spray tube to collectively direct fluid at parts to be washed from substantially all directions as the primary spray tube rotates about its axis of rotation.

5. The parts washer of claim 1, further comprising at least two outlets on the primary spray tube configured to direct fluid in a direction to cause fluid-propelled rotation of the primary spray about its axis of rotation.

6. The parts washer of claim 1, wherein all of the outlets on the primary spray tube are configured to direct fluid substantially toward parts to be washed on the support structure and to cause fluid-propelled rotation of the primary spray tube about its axis of rotation.

7. The parts washer of claim 1 wherein the primary spray tube has a vertical axis of rotation and the auxiliary spray tube is adjustably mounted on the spray tube in a generally horizontal configuration.

8. The parts washer of claim 1, wherein the auxiliary spray tube includes a pair of fastening mechanisms that enable the auxiliary spray tube to be adjustably and removably mounted on the spray tube.

9. The parts washer of claim 1, further including an a hoist mounted on the housing for assisting the loading and unloading of parts to and from the parts washer.

10. The parts washer of claim 1, wherein the auxiliary spray tube is in fluid communication with the spray tube.

11. The parts washer of claim 1, wherein the auxiliary spray tube receives fluid from the primary spray tube.

12. The parts washer of claim 1, wherein the parts washer includes a filter, and the housing includes a door through which parts are loaded into and removed from the support structure and an opening independent of the door through which the filter is accessible.

13. The parts washer of claim 1, wherein the parts washer further includes a sump adapted to collect fluid dispensed from the outlets, and a pump adapted to receive fluid from the sump and deliver fluid under pressure to the spray tubes.

14. The parts washer of claim 13, wherein the parts washer further includes a skimmer adapted to remove contaminants from the fluid in the sump.

15. The parts washer of claim 13, further comprising an evaporator adapted to evaporate fluid within the sump.

16. The parts washer of claim 13, further comprising a heater for heating fluid within the sump.

17. The parts washer of claim 16, further comprising a first thermostat for measuring the temperature of fluid within the parts washer and for automatically disengaging the heater if the temperature of the fluid exceeds a defined maximum temperature.

18. The parts washer of claim 17, further comprising a second thermostat for controlling the heater to maintain the temperature of fluid in the parts washer between defined upper and lower temperatures.

19. The parts washer of claim 16, wherein the parts washer further includes a pressure switch for disengaging the pump and the heater if pressure from fluid in the sump is less than a defined minimum pressure.

20. The parts washer of claim 1, wherein at least one of the outlets is adjustable to control at least one of the rate and the direction at which fluid is dispensed therefrom.

21. The parts washer of claim 1, wherein all of the outlets are adjustable to control at least one of the rate and the direction at which fluid is dispensed therefrom.

22. The parts washer of claim 1, wherein the primary spray tube rotates about a substantially vertical axis of rotation, and the parts washer includes a generally vertical door adapted to selectively allow or restrict access to the wash chamber.

23. The parts washer of claim 22, wherein the door is selectively rotatable about the axis of rotation of the spray tube.

24. A parts washer for washing parts, comprising:

a housing having a wash chamber;

a spray tube for receiving fluid under pressure from a pump, wherein the spray tube is rotatably coupled to the housing, has an axis of rotation and is configured to define a volume of rotation as it rotates about its axis of rotation;

a support structure configured to support parts to be washed, wherein the support structure is positioned within the housing and is at least substantially within the volume of rotation of the spray tube;

a plurality of outlets on the spray tube configured to direct fluid substantially toward parts to be washed on the support structure;

an auxiliary spray tube adjustably mounted on the spray tube and having a second plurality of outlets configured to direct fluid substantially toward parts to be washed on the support structure, wherein the auxiliary spray tube includes a pair of opposed ends, each of which is mounted on the spray tube; and at least one outlet on one of the spray tubes configured to direct fluid in a direction to cause fluid-propelled rotation of the spray tubes as a unit about the axis of rotation.

25. The parts washer of claim 24, wherein each of the ends includes a fastening mechanism adapted to adjustably and removably secure the corresponding end to the spray tube.

26. A parts washer for washing parts, comprising:

a housing having a wash chamber;

a spray tube for receiving fluid under pressure from a pump, wherein the spray tube is rotatably coupled to the housing, has an axis of rotation and is configured to define a volume of rotation as it rotates about its axis of rotation;

a support structure configured to support parts to be washed, wherein the support structure is positioned within the housing and is at least substantially within the volume of rotation of the spray tube;

a plurality of outlets on the spray tube configured to direct fluid substantially toward parts to be washed on the support structure;

an auxiliary spray tube adjustably mounted on the spray tube and having a second plurality of outlets configured to direct fluid substantially toward parts to be washed on the support structure;

at least one outlet on one of the spray tubes configured to direct fluid in a direction to cause fluid-propelled rotation of the spray tubes as a unit about the axis of rotation;

a filter; and a plurality of removable plates below the volume of rotation, wherein the plates are positioned within the housing to direct fluid dispensed from the outlets into the filter.

* * * * *